US006892392B2

(12) United States Patent
Crye et al.

(10) Patent No.: US 6,892,392 B2
(45) Date of Patent: May 17, 2005

(54) PERSONAL BODY ARMOR

(75) Inventors: Caleb Clark Crye, Brooklyn, NY (US); Eric Owen Fehlberg, Queens, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 270 days.

(21) Appl. No.: 10/255,157

(22) Filed: Sep. 25, 2002

(65) Prior Publication Data

US 2005/0010987 A1 Jan. 20, 2005

Related U.S. Application Data

(60) Provisional application No. 60/324,889, filed on Sep. 26, 2001.

(51) Int. Cl.[7] ..... F41H 1/02
(52) U.S. Cl. ..... 2/2.5
(58) Field of Search ..... 2/2.5, 455, 456, 2/459, 461, 462, 463, 464, 465, 467; 428/221, 223, 911; 442/189

(56) References Cited

U.S. PATENT DOCUMENTS

| | | | | | |
|---|---|---|---|---|---|
| 1,003,270 | A | | 9/1911 | Keill | |
| 1,298,618 | A | | 3/1919 | Wloszek | |
| 3,370,302 | A | | 2/1968 | Karlyn | |
| 3,784,984 | A | * | 1/1974 | Aileo | 2/423 |
| 3,873,998 | A | | 4/1975 | Norris et al. | |
| 4,507,802 | A | * | 4/1985 | Small | 2/2.5 |
| 4,660,223 | A | | 4/1987 | Fritch | |
| 4,783,853 | A | | 11/1988 | Zuber | |
| 5,060,314 | A | * | 10/1991 | Lewis | 2/2.5 |
| 5,220,691 | A | | 6/1993 | Wiegers | |
| 5,423,087 | A | * | 6/1995 | Krent et al. | 2/463 |
| 5,524,641 | A | * | 6/1996 | Battaglia | 128/846 |
| 5,534,343 | A | | 7/1996 | Landi et al. | |
| 5,581,805 | A | * | 12/1996 | Rennick | 2/455 |
| 5,652,967 | A | * | 8/1997 | Hsu | 2/463 |
| 5,996,115 | A | | 12/1999 | Mazelsky | |
| 6,012,162 | A | | 1/2000 | Bullat | |
| 6,182,299 | B1 | * | 2/2001 | Chen | 2/463 |
| 6,266,818 | B1 | | 7/2001 | Howland et al. | |
| 6,418,832 | B1 | | 7/2002 | Colvin | |

OTHER PUBLICATIONS

"How Body Armor Works—Stopping Bullets" by Tom Harris, web page printout http://www.howstuffworks.com/body–armor1.htm 3 pp. Sep. 23, 2002.
"How Body Armor Works—Let Me Be Blunt" by Tom Harris, web page printout http://www.howstuffworks.com/body–armor2.htm, 3 pp. Sep. 23, 2002.
"How Body Armor Works—Ranking Resistance" Tom Harris, web page printout http://www.howstuffworks.com/body–armor3.htm 4 pp. Sep. 23, 2002.

* cited by examiner

*Primary Examiner*—Gary L. Welch
(74) *Attorney, Agent, or Firm*—Stiennon & Stiennon

(57) ABSTRACT

Personal body armor has hard armor plates on the front and back of the wearer which extend between a left vest section and a right vest section formed of soft armor. Foam pads are affixed to the interior of the vest sections which space the soft armor and the hard armor plates from the wearer's body and define multiple vertically extending air channels between the wearer and the hard armor plates and the interior of the soft armor The air channels promote ventilation of the armor and cooling of the wearer. For additional comfort, the soft armor is formed of multiple conventional layers of ballistic material and a 1/16 inch molded plastic layer. The hard armor plates are configured to avoid interference with the usual range of motion of the wearer.

27 Claims, 3 Drawing Sheets

PERSONAL BODY ARMOR

CROSS REFERENCES TO RELATED APPLICATIONS

This application claims the benefit of the filing date of U.S. Provisional Application No. 60/324,889, filed Sep. 26, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to personal armor for protection against projectile threats in general, and more particularly to armor intended to counter higher speed projectiles such as rifle rounds.

Persons exposed to projectile threats, such as police officers and soldiers, may seek a certain level of protection by wearing armored clothing. Such body armor is available in a variety of forms to address various levels of potential threats.

Low velocity projectiles such as handgun rounds, fragmentation rounds from a grenade or mortar, and miscellaneous shrapnel may be countered by so-called "soft armor." Soft armor is worn in the form of jackets, vests, etc. which are composed of assemblies of ballistic fabric such as those formed from DuPont Kevlar® fibers. Typically, soft armor will employ 15–30 layers of thin flexible tightly woven ballistic fabric. This material is generally lightweight and effective in stopping handgun rounds. However, the multiple layers required to make the soft armor are also an effective insulator, trapping heat close to the wearer's body.

In a more serious threat situations, where higher velocity rifle rounds must be countered, soil armor has typically been supplemented with hard armor. The hard armor is fabricated of rigid plates of ceramic, polymer, or metal. These plates are usually molded or formed to conform to a standard wearer. To provide the greatest area of coverage, and hence protection, these plates are often large and hence can interfere with the wearer's mobility. A common approach to mounting the plates to the wearer is to secure them within exterior pockets fabricated on a soft armor jacket or vest. This modular approach allows the wearer to assess the level of risk and to add or subtract hard armor as the situation demands. However, the result is a more bulky and potentially hot armor assembly. Because the hard armor plates can compromise mobility, the wearer may choose to sacrifice a greater level of protection for greater ease of movement. The option to remove some levels of protection, however, means that occasionally the wearer of the armor encounters a higher velocity projectile without the appropriate hard armor protection.

What is needed is a body armor system which is effective against high velocity projectiles yet which does not unduly compromise wearer mobility or temperature regulation.

SUMMARY OF THE INVENTION

The body armor of this invention has hard armor plates which are not removable in normal use. The hard armor plates on the front and back of the wearer extend between a left vest section and a right vest section formed of soft armor. The vest sections are spaced from one another in the front and back of the wearer, leaving no soft armor behind the hard armor plates at the front and back. Foam pads are affixed to the interior of the vest sections to evenly distribute the weight of the armor and to space the soft armor and the hard armor plates from the wearer's body. Thus multiple vertically extending air channels are defined between the wearer and the hard armor plates and the interior of the soft armor. The air channels promote ventilation of the armor and cooling of the wearer. For additional comfort, the soft armor is formed of multiple conventional layers of ballistic material and a 1/16 inch molded plastic layer. In addition, the hard armor plates are configured to avoid interference with the usual range of motion of the standard wearer. Upper and lower armor plates may be independently attached to the front sections of the vest sections, and thereby allowed to slide with respect to one another as the wearer moves.

It is an object of the present invention to provide body armor which guards against high velocity projectiles.

It is another object of the present invention to provide body armor which permits natural convective cooling of the wearer.

It is a further object of the present invention to provide body armor which is more comfortably worn.

Further objects, features and advantages of the invention will be apparent from the following detailed description when taken in conjunction with the accompanying drawings.

DESCRIPTION OF THE PREFERRED EMBODIMENTS

Figure 1:
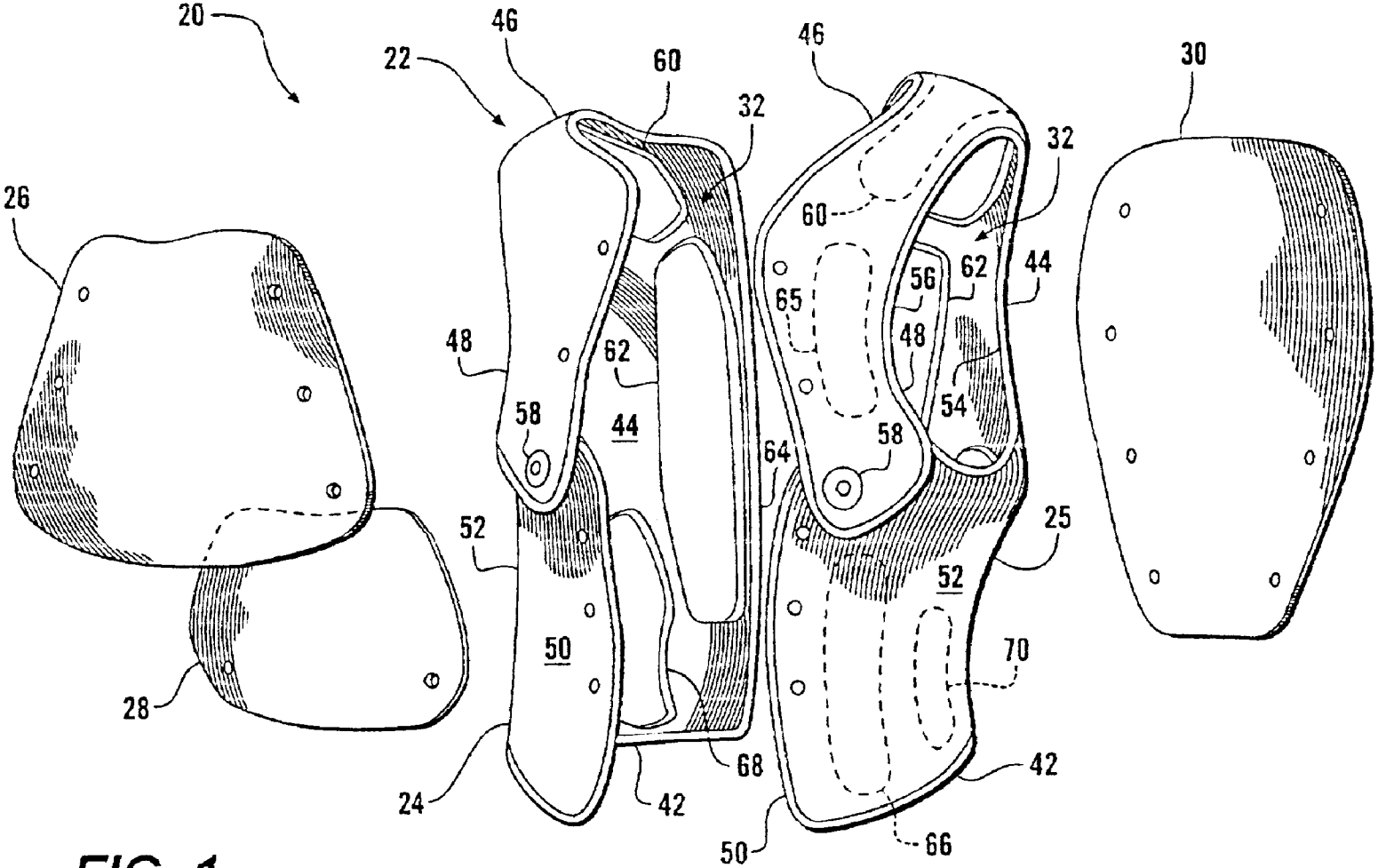
FIG. 1 is an exploded isometric view of the body armor of this invention.
Figure 2:
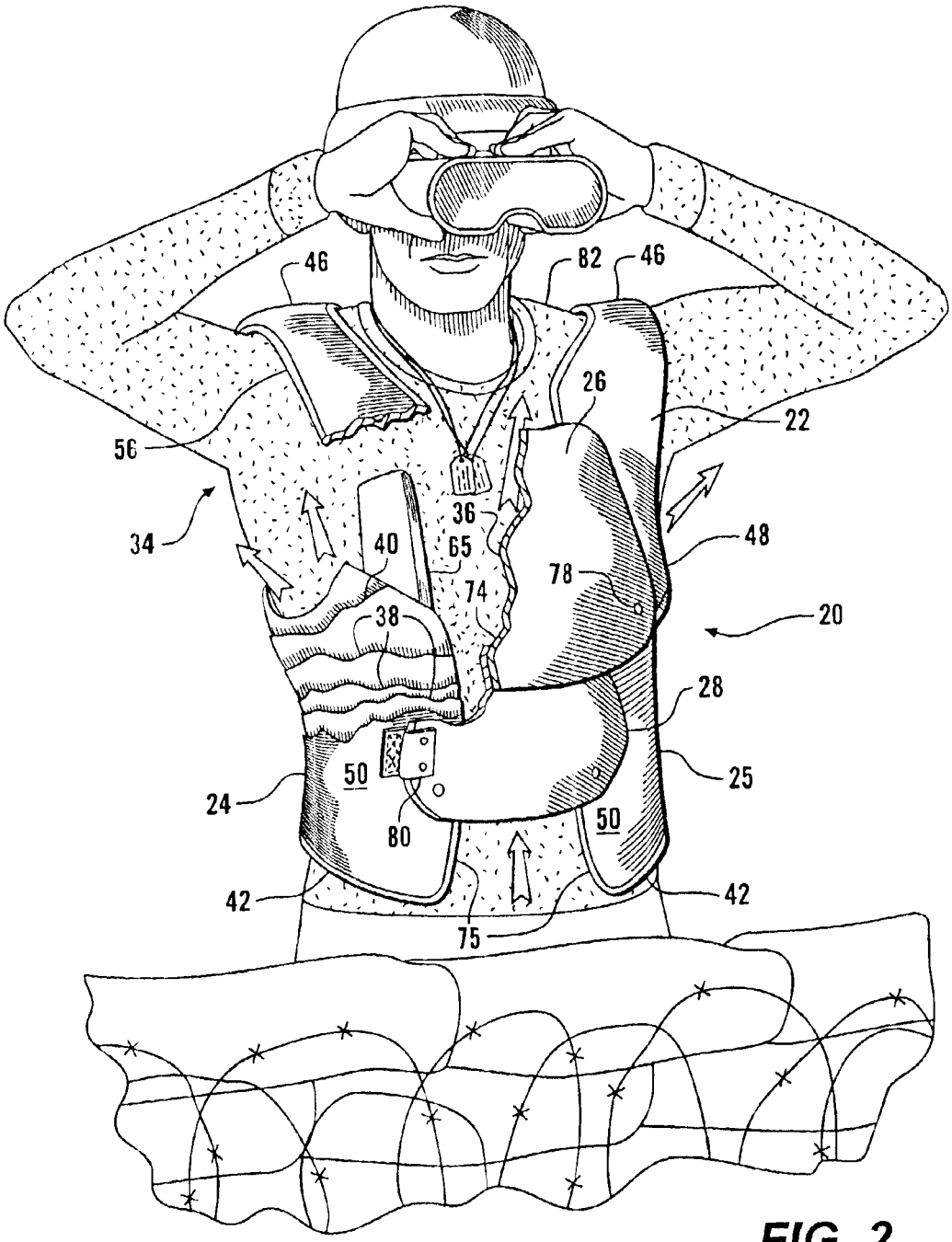
FIG. 2 is a perspective view, partially cut away in section, of the body armor of FIG. 1 as worn by a soldier.
Figure 3:
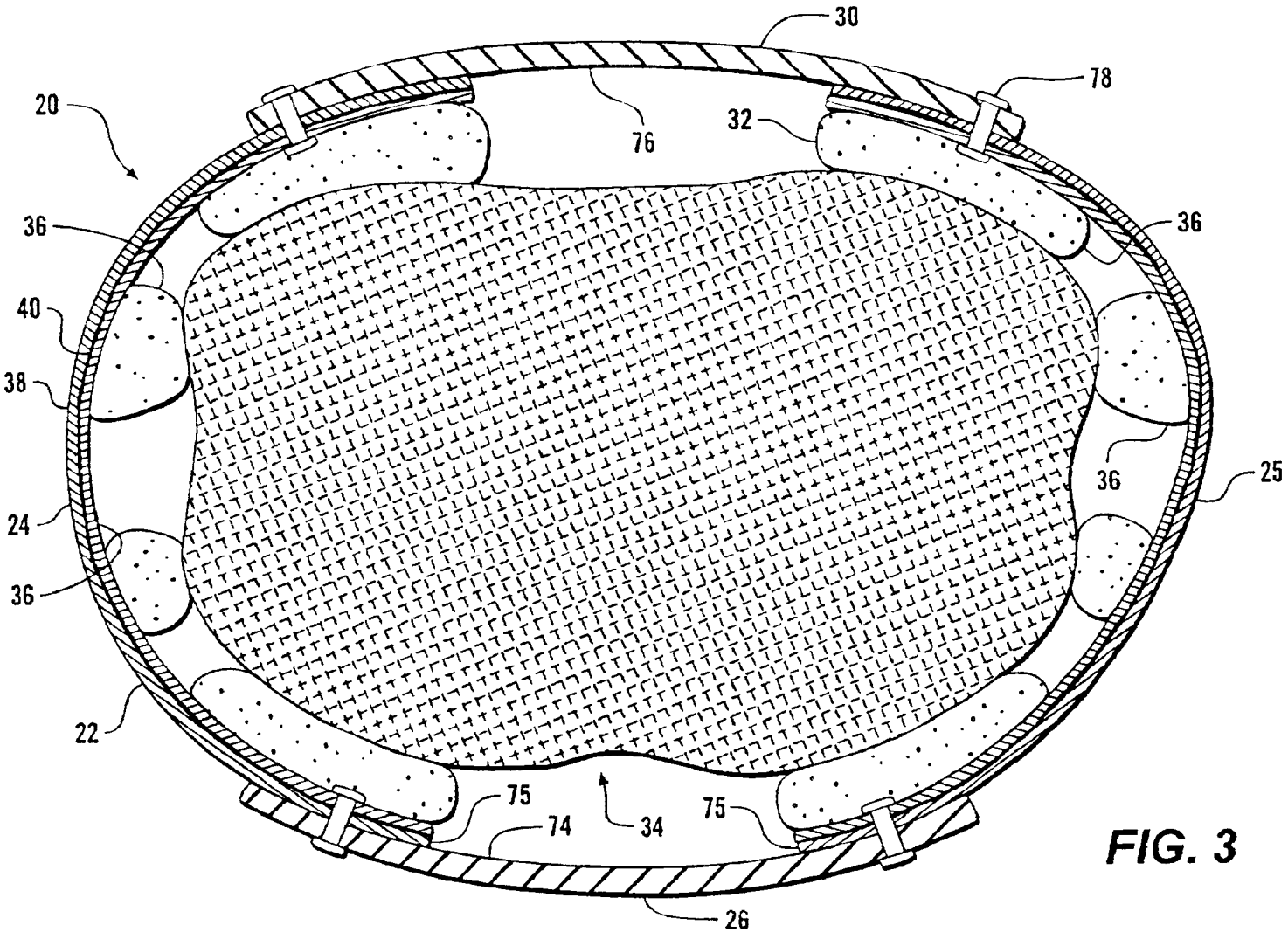
FIG. 3 is a cross-sectional view of the body armor of FIG. 2.

Referring more particularly to FIGS. 1–3, wherein like numbers refer to similar parts, the body armor 20 of this invention is shown. The body armor 20 is composed of a soft armor vest 22 which has a right vest section 24 and a left vest section 25. The vest sections 24, 25 are connected by rigid hard armor plates. The plates include two front plates; an upper breast plate 26 which overlaps a lower abdomen plate 28; and a back plate 30. A system 32 of closed cell foam pads is affixed to the inside of each vest section 24, 25. The system of pads 32 spaces the vest 22 from the wearer 34, as shown in FIG. 2, such that a plurality of air channels 36 are defined between die wearer and the soft armor.

The vest sections 24, 25 are fabricated of multiple layers of ballistic fabric material, for example Mont Kevlar® material, Akzo's Twaron® T-2000 microfilament aramid fiber material, or other conventional ballistic fabric. As in a conventional soft armor system, the 15–30 layers 38 of ballistic fabric, as shown in FIG. 2, serve to slow down and disperse energy of an incoming projectile. Soft armor is usually adequate for dealing with handgun rounds, fragmentation rounds from a grenade or mortar or other low velocity, subsonic projectile threats.

A molded plastic stiffening layer 40 provides some three-dimensional shape to each vest section 24, 25. The stiffening layer 40 provides a semi-gold sheet that runs the length of the wearer's back as it extends along the back panel and throughout each vest section. The stiffening layer 40 is coextensive with at least 50 percent of the ballistic soft armor, and preferably extends along substantially the entire vest section. The vest sections may be assembled by cutting with a die or other means the multiple layers 38 of ballistic fabric, then cutting with a similar die the single stiffening layer 40. The stiffening layer 40 may be cut from a sheet of nylon, polyethylene, or other thermoplastic material. Once the stiffening layer 40 has been assembled with the ballistic fabric layers 38, for example being placed between layers of ballistic fabric, hems 42 are applied to finish the edges, and the entire assembly is heat formed to roughly the shape the vest section will take on when worn by a wearer 34, for example by being formed over a cylindrical mold. The stiffening layer 40 may be only approximately 1/16 inch thick, and thus, although it imparts some stiffness to the vest section, it is lightweight, and still readily conformable to the shape of the individual wearer 34. Yet this added stiffness reduces the tendency of the ballistic material to form folds which can reduce wearer comfort and add to the effort of wearing the armor 20.

As shown in FIG. 1, each vest section 24, 25 has a back panel 44 which is positioned rearwardly of the wearer 34 and which is connected by a shoulder section 46 to a breast flap 48. A torso segment 50 is connected by a side section 52 to the back panel 44. The torso segment 50 and the breast flap 48 define the front panels of the vest sections. The breast flap 48, the shoulder section 46, the back panel 44, and the torso segment 50 have an outer edge 54 which delineates an armhole 56 through which the wearer's arm extends as shown in FIG. 2.

The lower portion of the breast flap 48 may be secured or sewn to the upper portion of the torso segment 50, or, as shown in FIGS. 1 and 2, they may be pivotably connected at a rotatable joint 58.

Each of the pads 60, 62, 65, 66, 68, 70 of the pad system 32 is formed of an open mesh fabric which encloses a closed cell foam resilient block. The foam block may be, for example, EDA foam, or alternatively, expanded polyethylene foam, which is a breathable viscoelastic foam. The open mesh fabric may be a 3D spacer fabric, or, alternatively, a closed smooth surface nylon or cotton, or a wicking material, such as duPont COOLMAX® material, or a low friction nylon material. A preferred material would be low in friction while permitting high air travel. Alternatively, the foam blocks may be enclosed in leather, or may be exposed without any enclosure.

The pad system 32 for each vest section 24, 25 is comprised of multiple repositionable pads provided with fastening means for adjustable positioning on the interior surface of the vest sections. Preferably, each pad is provided with one part of a hook and loop fastener system. Other readily positionable fastening system may also be used. The pad system 32 may include a shoulder pad 60 which extends from the back panel 44 along the shoulder section 46 to the breast flap 48; an upper back pad 62 which extends vertically in the vicinity of the rear margin 64 of the back panel; an upper front pad 65 on the breast flap 48; a lower front pad 66 on the torso segment 50; and a lower back side pad 68 and front side pad 70 on the side section 52.

As shown in FIG. 3, the pads are about one-half inch to two inches thick, preferably about one inch thick, and serve several purposes. First, the pads position the heat insulative soft armor away from contact with the body of the wearer. Thus spacing creates a plurality of air channels 36 extending generally vertically around the body of the wearer 34. The multiple air channels 36 extend upwardly from a lowermost extremity of the vest to an uppermost extremity. The foam pads cover less than 75 percent of the interior surface of the vest, leaving generous volume for air flow around the wearer. These channels permit the flow of air past the wearer's body and serve to prevent heat buildup, thereby permitting greater activity of the wearer before overheating. Second, the pads cushion the weight of the armor 20 and distributed it across the wearer's body. Third, by spacing the rigid armor plates 26, 28, 30 from the wearer's body, any back of the plate deformation of an armor plate as the result of projectile impact is less likely to contact and injure the wearer. Moreover, the force of the impact may be spread over a larger area. Fourth, the closed cell foam of the pads adds flotation to the wearer should it be necessary to enter a body of water. Not only do the pads counter the added weight of the body armor 20, but the pads will usually represent a net buoyancy, helping to keep the wearer afloat.

It will be noted, as shown in FIGS. 1 and 2, that the right vest section 24 is connected to the left vest section 25 by the back plate 30. Thus it will be apparent that it is not an option to wear the armor 20 without the back plate 30. In a similar fashion, the breast plate 26 and abdomen plate 28 are required to connect the vest sections 24, 25, although a single font plate could be substituted for the two plates. Hence, it is the rigid armor plates 26, 28, 30 which provide ballistic protection to the front and rear of the wearer. The hard armor plates provide two portions which are positioned so that when the vest is worn a wearer's vital organs are positioned between said at least two portions.

Because use of the armor plates is not optional, the armor 20 may safely dispense with soft armor to the front and rear of the wearer, between the wearer and the armor plates. Although there is some overlap of the hard armor plates with the soft armor for mounting purposes, more than 50 percent of the hard armor is not backed by woven ballistic soft armor. As a result, a wide front air channel 74 is defined between the front margins 75 of the vest sections 24, 25, and a wide rear air channel 76 is defined between the rear margins of the vest sections.

As shown in FIG. 1, the armor plates 26, 28, 30 are connected to the vest sections 24, 25 by a plurality of fasteners 78. The fasteners 78 may be rivets which extend through drilled holes in the armor plates and through the fabric of the soft armor. Alternatively, as shown in FIG. 2, the plates, may be riveted to fabric flaps or hinges 80 which are in turn sewn to the vest sections 24, 25. The armor plates may be fabricated of conventional armor plate material such as ceramics, titanium, hardened PBO, or any hard armor material.

For most comfortable use of the armor 20, it should be worn over a wicking undershirt 82, for example formed of duPont CoolMax® material. Although not shown in the drawings, the vest 22 should be provided with a size arrangement, such as belts, straps, or ties to adjust the armor 20 for a snug and comfortable fit on the wearer. For example a single cord may be laced through an array of grommets or cord holes on opposing hems of the vest sections 24, 25 at the front and the rear of the vest, in a corset-like arrangement.

It should be noted that there are various alternative approaches to the front hard armor plate mounting of the body armor of this invention. The breast plate and the abdomen plate may be independent of each other and connected only along the sides. Or, the bottom of the breast plate may be pinned to the top of the abdomen plate in a pivoting connection, or, the two plates may be connected along a fabric hinge which allows a wide range of movements between the two front plates. Alternatively, only a single front plate may be used.

The hard armor are shaped with particular attention to the common movements of a wearer, and are designed to minimize restrictions of movement. At the full range of motion, a standard wearer's arms and legs won't interfere with the plates. The wearer should never feel them throughout a fall range of motion. The plates tend to be taller, and somewhat thinner than conventional hard armor plates. A single plate can accommodate a variety of wearers.

Depending on the threats expected, alternative body armor systems could be constructed with lower levels of threat resistance. For example, the front and rear armor plates could be fabricated as soft armor segments, which can be riveted or fastened to the vest sections in the same manner as the hard armor, while still preserving the cooling effect of the spacing of the armor from the wearer.

It should be noted that, although the soft armor provides better comfort when formed with the molded plastic layer described above, the soft armor vest could also be fabricated without the stiffening plastic layer.

Alternative fastening means for attaching the hard armor plates to the vest sections would include small plastic tabs with sockets on the plates, which engage in sliding connection with projections from the vest sections, to thereby allow the plates to slide when the armor is tightened up.

It is understood that the invention is not limited to the particular construction and arrangement of parts herein illustrated and described, but embraces all such modified forms thereof as come within the scope of the following claims.

We claim:

1. Body armor comprising:

a vest having a right vest section and a left vest section, the vest being fabricated of soft armor, each vest section having portions defining an arm hole and a back panel positioned rearwardly of the arm hole and at least one front panel extending frontwardly of the arm hole;

at least one pad extending inwardly from the back panel of each vest section, and at least one pad extending inwardly from the at least one front panel of each vest section, wherein the pads when engaged against a wearer serve to space the vest soft armor from contact with the wearer to define at least one air channel extending upwardly through the vest; and at least one rigid front plate connected to the vest, the front plate extending between the at least one front panel of each vest section, and connecting the right vest section to the left vest section such that portions of the of least one front plate do not overlie the soft armor of the left or right vest sections and are spaced from the wearer with a front air channel defined between the at least one front plate and the wearer.

2. The body armor of claim 1 wherein the at least one rigid front plate comprises:

a rigid breast plate mounted between the at least one front panel of the right vest section and the at least one front panel of the left vest section; and a rigid abdomen plate having upper portions which are positioned rearwardly of the breast plate, the abdomen plate being mounted between the at least one front panel of the right vest section and the at least one front panel of the left vest section, the front air channel being defined rearwardly of the breast plate and abdomen plate.

3. The body armor of claim 2 wherein the at least one front panel of the right vest section comprises a right upper breast flap connected to the right vest section back panel by a right shoulder section, and right waist section connected to the right vest section back panel by a right side section, and wherein the at least one front panel of the left vest section comprises a left upper breast flap connected to the left vest section back panel by a left shoulder section, and a left waist section connected to the left vest section back panel by a left side section, and wherein each upper breast flap overlies the waist section of its respective vest section and is connected thereto, and wherein the breast plate is connected between the upper breast flaps, and the abdomen plate is connected between the waist sections.

4. The body armor of claim 1 wherein the vest soft armor comprises:

a plurality of layers formed of ballistic material; and at least one layer of stiffening material connected with the plurality of layers of ballistic material.

5. The body armor of claim 1 further comprising at least one hard armor back plate which extends between the right vest section and the left vest section.

6. The body armor of claim 5 wherein one of the plurality of pads is mounted to each of the right vest section and the left vest section to space the back plate from the wearer and to define a rear air channel between the back plate and the wearer.

7. The body armor of claim 1 wherein the pads when engaged against a wearer serve to space the vest soft armor from contact with the wearer to define a plurality of air channels between the soft armor and the wearer for ventilation of the wearer.

8. The body armor of claim 1 wherein the rigid front plate comprises hard armor, and wherein more than 50 percent of the hard armor is not backed by soft armor.

9. An armored vest comprising a garment forming a vest constructed of ballistic armor, the vest having an interior surface, to which are mounted a plurality of inwardly extending pads which space the vest interior surface from a wearer, the pads defining at least two upwardly extending air channels, which extend from a lowermost extremity of the vest to an uppermost extremity, said channels extending through the vest, the pads covering less than all of the interior surface of the vest.

10. The armored vest of claim 9 further comprising a layer of semi-rigid plastic which is coextensive with portions of the ballistic soft armor.

11. The armored vest of claim 10 wherein the layer of semi-rigid plastic is coextensive with at least 50 percent of the ballistic soft armor.

12. The armored vest of claim 9 wherein the vest ballistic armor comprises soft armor and hard armor, the hard armor including a front plate which extends frontwardly of one of the two upwardly extending air channels.

13. The body armor of claim 12 wherein the vest ballistic armor further comprises at least one hard armor back plate which extends rearwardly of one of the two upwardly extending air channels.

14. The body armor of claim 13 wherein the vest has a right vest section and a left vest section which are spaced from one another, and wherein one of the plurality of pads is mounted to each of the right vest section and the left vest section to space the back plate from the wearer and to define a rear air channel between the back plate and the wearer.

15. The body armor of claim 9 wherein the vest has a right vest section and a left vest section formed of soft armor, and a front plate formed of hard armor is connected between the right vest section and the left vest section.

16. The body armor of claim 9 wherein the vest has a molded plastic stiffening layer which provides three-dimensional shape which reduces the tendency of the ballistic armor to form folds.

17. An armored vest comprising a garment forming a vest constructed of ballistic armor, the vest having an interior surface to which are mounted a plurality of pads, the pads defining at least two upwardly extending air channels, which extend from a lowermost extremity of the vest to an uppermost extremity, the pads covering less than all of the interior surface of the vest, wherein the vest is constructed of soft ballistic armor and hard armor of metal or ceramic construction, and wherein more than 50 percent of the hard armor is not backed by soft ballistic armor.

18. The armor vest of claim 17 wherein the hard armor has at least two portions which are positioned so that when the vest is worn a wearer's vital organs are positioned between said at least two portions.

19. The armored vest of claim 18 wherein the at least two upwardly extending air channels extend one along each of the hard armor at least two portions.

20. Body armor comprising:

a right vest section fabricated of soft armor and having a right arm hole;

a left vest section fabricated of soft armor and having a left arm hole, wherein each vest section has an interior surface facing a wearer;

a plurality of pads mounted to the interior surface of each vest section and extending inwardly to space the soft armor from engagement with the wearer, the pads covering substantially less than all of the vest section interior surfaces, wherein the pads when engaged against a wearer define at least one air channel; and at least one hard armor front plate connected between the right vest section and the left vest section, such that portions of the at least one front plate do not overlie the soft armor of the vest sections and said pads space the hard armor front plate from the wearer with a front air channel extending upwardly through the vest defined between the at least one front plate and the wearer.

21. The body armor of claim 20 further comprising at least one hard armor back plate which extends between and is connected between the right vest section and the left vest section.

22. The body armor of claim 21 wherein one of the plurality of pads is mounted to each of the right vest section and the left vest section to space the back plate from the wearer and to define a rear air channel between the back plate and the wearer.

23. The body armor of claim 20 wherein the right vest section and the left vest section each has a molded plastic stiffening layer which provides three-dimensional shape which reduces the tendency of the ballistic armor to form folds.

24. The body armor of claim 20 wherein more than 50 percent of the hard armor front plate is not backed by soft armor.

25. An armored vest comprising a garment forming a vest constructed of ballistic armor, the vest having an interior surface, to which a pad system is mounted, the pad system extending inwardly from the vest interior surface to space the vest interior surface from a wearer, the pad system defining at least two upwardly extending air channels, which extend from a lowermost extremity of the vest to an uppermost extremity, said channels extending upwardly through the vest.

26. The armored vest of claim 25 wherein the vest ballistic armor further comprises a hard armor front plate which extends frontwardly of at least one of the upwardly extending air channels.

27. An armored vest comprising:

a garment forming a vest, constructed of ballistic armor, the vest having an interior surface, a lowermost extremity and an uppermost extremity; and means for spacing the interior surface of the vest from a wearer, the means for spacing being connected to the vest and extending towards the wearer and defining at least two upwardly extending air channels, which extend from the lowermost extremity of the vest to the uppermost extremity, said channels extending upwardly through the vest.

* * * * *

UNITED STATES PATENT AND TRADEMARK OFFICE

CERTIFICATE OF CORRECTION

PATENT NO. : 6,892,392 B2
APPLICATION NO. : 10/255157
DATED : May 17, 2005
INVENTOR(S) : Caleb Clark Crye et al.

It is certified that error appears in the above-identified patent and that said Letters Patent is hereby corrected as shown below:

Column 2, line 64 of the issued patent, "semi-gold" should be --semi-rigid--

Signed and Sealed this

Seventeenth Day of April, 2007

JON W. DUDAS
*Director of the United States Patent and Trademark Office*